United States Patent [19]

Unger

[11] 4,143,519

[45] Mar. 13, 1979

[54] DRIVE SHIELD

[75] Inventor: Eberhard Unger, Lunen, Fed. Rep. of Germany

[73] Assignee: Gewerkschaft Eisenhutte Westfalia, Lunen, Fed. Rep. of Germany

[21] Appl. No.: 875,726

[22] Filed: Feb. 7, 1978

[30] Foreign Application Priority Data

Feb. 12, 1977 [DE] Fed. Rep. of Germany ..... 2706024

[51] Int. Cl.[2] ..... E21D 19/00

[52] U.S. Cl. ..... 405/145

[58] Field of Search ..... 61/85, 84, 41 A

[56] References Cited

U.S. PATENT DOCUMENTS 4,063,425 12/1977 Jutte ..... 61/85

FOREIGN PATENT DOCUMENTS 2500624 7/1976 Fed. Rep. of Germany ..... 61/85

*Primary Examiner*—Jacob Shapiro

*Attorney, Agent, or Firm*—Sughrue, Rothwell, Mion, Zinn and Macpeak

[57] ABSTRACT

A drive shield for driving wide underground cavities comprises a plurality of knife shields arranged side-by-side transversely of the direction of advance. Each knife shield has a plurality of elongate knives displaceably mounted on a respective support frame. The elongate knives are advanceable relative to their support frame by means of hydraulic rams mounted on that support frame. The support frames of each pair of adjacent knife shields are linked by connecting means such as double-acting hydraulic rams, which permit one of the support frames to be advanced relative to the other.

10 Claims, 3 Drawing Figures

DRIVE SHIELD

BACKGROUND OF THE INVENTION

This invention relates to a drive shield, and in particular to a drive shield which can be used for driving wide underground cavities, for example cavities used in the building of underground stations or their surrounding structures.

In order to drive tunnels, mine galleries and the like, it is known to use knife shields. A knife shield has a plurality of elongate planks (knives) supported side-by-side on a frame. The knives can be advanced either singly or in groups by means of hydraulic rams, there being a respective hydraulic ram associated with each knife. All the rams are mounted on the frame which acts as an abutment for the rams. When all the knives have been advanced, the frame is drawn up in a follow-up sequence by pressurising the rams in the opposite direction.

It is also known to form a wide cavity for receiving a concrete arched ceiling and tunnel walls by using a drive shield which consists of a plurality of knife shields which are arranged side-by-side tranversely of the direction of advance, the support frames of the shields being hinged to each other to form a chain. The disadvantage of such a drive shield is that the knives of some of the shields tend to retract as the frames are pulled up in the follow-up sequence.

The aim of the present invention is to provide a drive shield which can be used for driving wide underground cavities in an economical manner without the disadvantages of the known arrangements.

SUMMARY OF THE INVENTION

The present invention provides a drive shield for driving wide underground cavities, the drive shield comprising a plurality of knife shields arranged side-by-side transversely of the direction of advance, each knife shield having a plurality of elongate knives displaceably mounted on a respective support frame, the elongate knives being advanceable relative to their support frame by means of hydraulic rams mounted on that support frame, wherein the support frames of each pair of adjacent knife shields are linked by connecting means which permit one of the support frames to be advanced relative to the other. Thus, the support frames are so linked together by the connection means that during advance of one of the support frames, the drive shield or shields adjacent to it is or are able to form abutment means for ensuring that advance. There is therefore no danger that, while a given support frame is being advanced in follow-up sequence, the knives of that shield, which are in frictional contact with the surrounding earth, will be retracted.

Advantageously, the connecting means associated with the support frames of each pair of adjacent knife shields is constituted by at least one stepping device at the top thereof, and by at least one stepping device at the base thereof. Preferably, each stepping device is a double-acting hydraulic ram, and these rams may act either alone or in co-operation with the knife-advance rams, to advance the respective support frame. Moreover, when the knives of a given shield are advanced, the frame advance rams also carry out a supporting function in that they support their support frame and prevent it being pressed in a direction opposite to that of advance. Because of the improved abutment, it is also possible to advance several knives of a given shield simultaneously without the danger arising of the associated support frame being forced backwards as a reaction to the high pressures necessary for such an advance.

The linking of the support frames at their tops and bases ensures that they are reliably supported, and that the frames are efficiently guided, without tilting, while they are advanced in follow-up sequence.

Preferably, the cylinder of each of said double-acting ram is pivotally connected to one of the associated support frames and the piston rod of that ram is pivotally connected to the other associated support frame.

Advantageously, when there are three or more knife shields, the or each inner knive shield has a greater width than the two outer knife shields. The advance of such inner support frames of greater width, and therefore greater weight, can be achieved without difficulty by the frame advance rams of the two adjacent frames. Alternatively, all the drive shields could have the same height and width.

This drive shield can be used particularly advantageously for producing a concrete roof in sections. In this case, a respective shuttering element is connected to each support frame in such a manner that the individual shuttering elements can be advanced independently of each other. Preferably, each shuttering element is connected to its support frame by hydraulic ram means.

When forming a concrete roof for tunnel structures and the like, it may also be expedient for the height of the knife shields to be considerably greater than the thickness of the concrete roof that is to be produced, but less than the internal height of the finished structure. This results in a sufficiently large working area to the rear of the knife shields and below the concrete roof, which can be used for carrying out the concreting operations, feeding in the concrete and possibly also for removing rubble and conveying materials.

BRIEF DESCRIPTION OF THE DRAWINGS

A drive shield constructed in accordance with the invention will now be described, by way of example, with reference to the accompanying drawings, in which.

DESCRIPTION OF PREFERRED EMBODIMENT

The illustrated drive shield is used for forming a cavity for a concrete roof 10 of an underground structure such as, for example, an underground station. The drive comprises a plurality of knife shields 11, 12, 13 etc. which are arranged side-by-side tranversely of the direction V of advance, and which together form a shield compartment whose width equals that of the structure to be built. Each of the knife shields 11, 12, 13 etc. has a support frame 14 which consists of frame portions 15 and 16 which are spaced one behind the other in the direction V of advance, these frame portions being connected together to form a rigid frame structure by means of longitudinal and/or diagonal struts.

Figure 1:
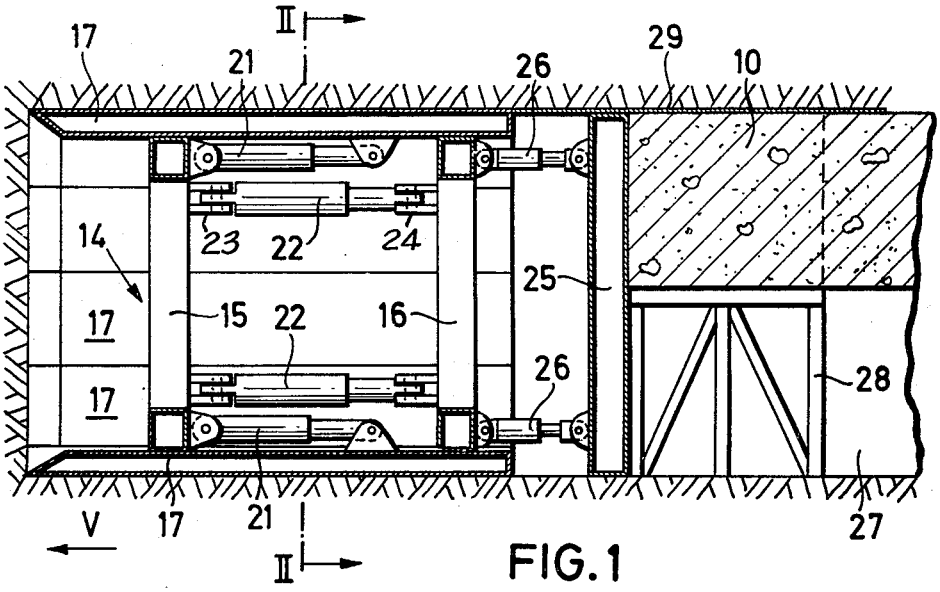
FIG. 1 is a longitudinal section through the drive shield.
Figure 2:
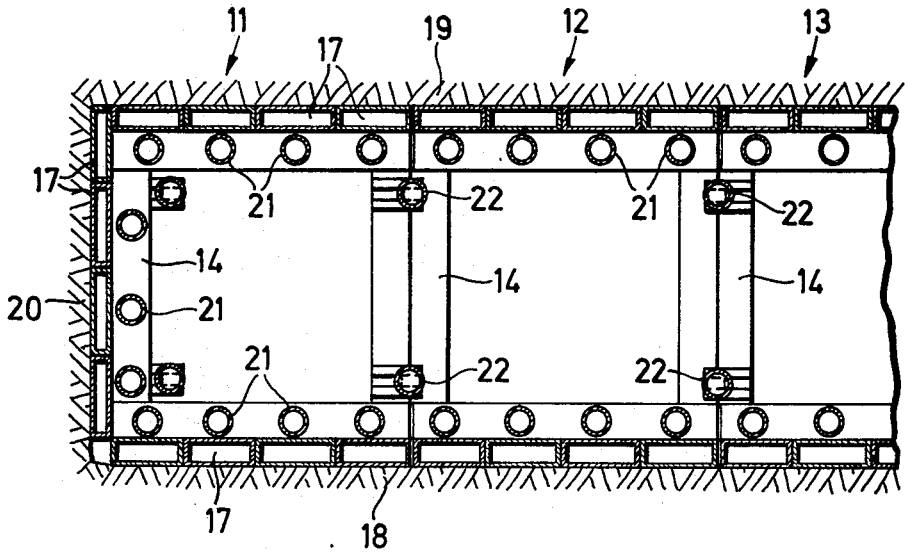
FIG. 2 is a partial cross-section taken on the line II—II of FIG. 1.
Figure 3:
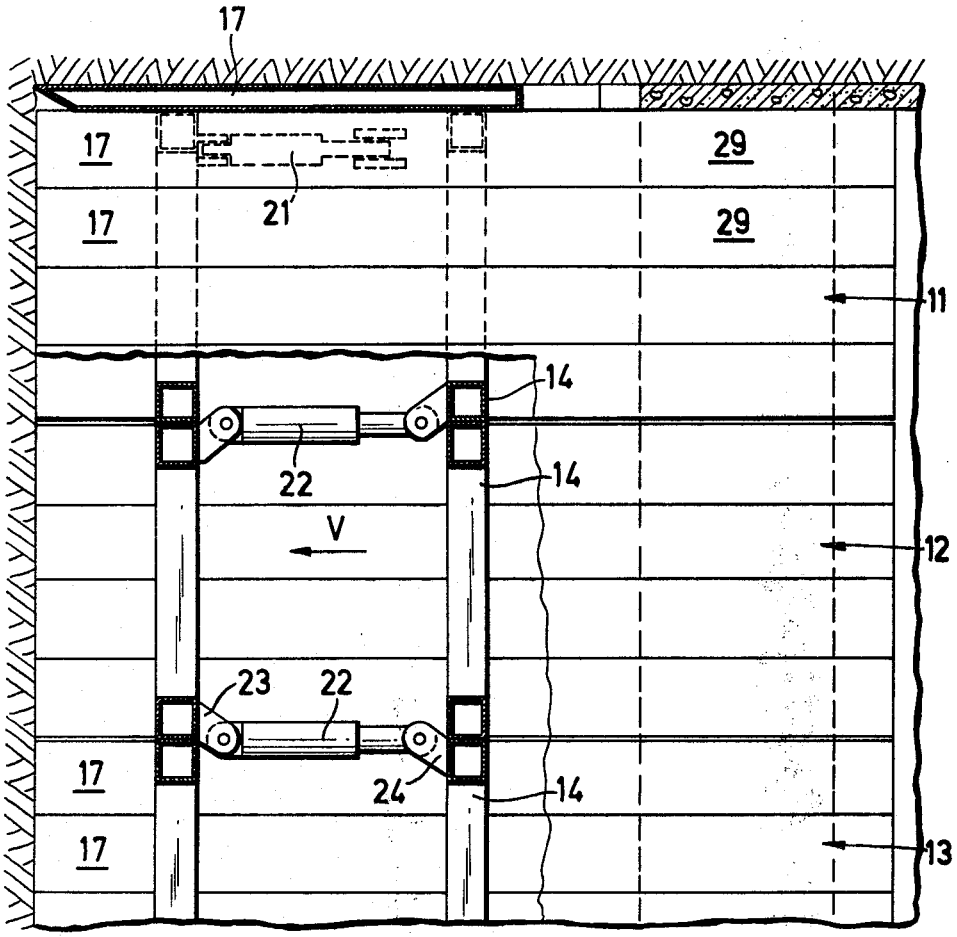
FIG. 3 is a plan view, partly in horizontal cross-section, of part of the drive shield of FIGS. 1 and 2.

Each of the drive shields and support frames is of box-like construction. Each knife shield has knives 17 at its floor 18 and at its roof 19, the knives being supported on the associated support frame 14 and being arranged side-by-side in a parallel formation. The two outer knife shields (of which only the left hand shield 11 is shown in FIG. 2) likewise have knives 17 at that side thereof facing the side-wall 20 of the cavity. Associated with each knife 17, is a double-acting hydraulic ram 21 which (as shown particularly in FIG. 1) acts between that knife and its frame 14. It is, therefore, possible to advance the knives 17, either individually or in groups by means of rams 21, the frame 14 forming an abutment for this advance of the knives. During the advance of the knives 17, its frame 14 is supported by the frictional contact between the knives not being advanced and the surrounding internal surfaces of the cavity. When all the knives 17 of the knife shields have been advanced the frames 14 are pulled up in a follow-up sequence in a manner to be described below.

The knife shields of each adjacent pair are linked at the roof and the floor by respective double-acting hydraulic rams 22, the cylinder of each ram 22 being connected by a pivot joint 23 to one of the support frames 14, while its piston-rod is connected by a pivot joint 24 to the adjacent support frame. If, for example, the support frame 14 of the knife shield 12 is to be advanced (after all the knives 17 of all the shields have been advanced) in the direction V, then this can be achieved with the aid of the four rams 22 which are supported on the support frames 14 of the two adjacent knife shields 11 and 13. Similarly, the support frames 14 of the other knife shields can then be advanced in follow-up sequence with the aid of the corresponding rams 22. At the same time as the rams 22 are pressurised to advance the frames, the rams 21 can be pressurised in the opposite direction to that in which they were pressurised to advance the knives 17. This reverse pressurisation of the rams 21 assists with the advance of the frames 14. It is, however, possible to use only the rams 22 for advancing the support frames 14, rams 21 then being switched to a non-pressurised condition.

When advancing the knives 17 of a given support frame 14, with the aid of the rams 21, that support frame can be supported against the adjacent support frame or frames by hydraulically blocking the relevant rams 22.

The rear of each knife shield 11, 12, 13 etc. is provided with a respective shuttering section 25 each of which is connected to its support frame 14 by means of hydraulic rams 26. The shuttering sections 25 form a front shuttering for the concreting operations. It can be seen from FIG. 1 that the height of the knife shields 11, 12, 13 etc. and the shuttering sections 25 is considerably greater than the thickness of the concrete roof 10 that is to be provided, so that, below the concrete roof, there is a sufficiently deep working zone 27 for carrying out the necessary concreting operations, the removal of rubble, the conveying of materials etc. The concrete roof 10 is formed in sections, utilising a lower shuttering formed by shuttering frames, carriages or the like 28, and an upper shuttering formed by tail extensions 29 of the roof knives 17. The shuttering frames 28 of the lower shuttering can be connected to the front shuttering 25 so that they can be advanced therewith by the rams 26.

In the illustrated embodiment, all of the knife shields 11, 12, 13, etc. are of the same width. It is, however, possible to use knife shields of varying widths, the inner shields expediently having a greater width than the exterior shields. It is also possible to link adjacent support frames 14, to form a rigid support structure, with the aid of releasable mechanical joints. In this case, the two linked shields can be advanced as a single unit. Thus, for example, the support frames 14 of the inner knife shields 12 and 13 may be linked to form a support unit which can be advanced with the aid of the rams 22 bearing against the two adjacent knife shields (only one of which—knife shield 11—can be seen in the drawings).

I claim:

1. A drive shield for driving wide underground cavities, comprising: a plurality of knife shields arranged side-by-side transversely of the direction of advance, an equal plurality of support frames individually associated with the knife shields, each knife shield having a plurality of elongate knives displaceably mounted on a respective support frame, the elongate knives being advanceable relative to their support frame be means of hydraulic rams mounted on that support frame, wherein the support frames of each pair of adjacent knife shields are linked by connecting means which permit one of the support frames to be advanced relative to the other.

2. A drive shield according to claim 1, wherein the connecting means associated with the support frames of each pair of adjacent knife shields is consituted by at least one stepping device at the top thereof, and by at least one stepping device at the base thereof.

3. A drive shield according to claim 2, wherein each stepping device is constituted by a double-acting hydraulic ram.

4. A drive shield according to claim 3, wherein the cylinder of each of said double-acting ram is pivotally connected to one of the associated support frames and the piston rod of that ram is pivotally connected to the other associated support frame.

5. A drive shield according to claim 1, wherein, when there are three or more knife shields, the or each inner knife shield has a greater width than the two outer knife shields.

6. A drive shield according to claim 1 wherein the support frames of at least one pair of adjacent knife shields are detachably connected to one another.

7. A drive shield according to claim 1, wherein a respective shuttering element is connected to each support frame.

8. A drive shield according to claim 7, wherein each shuttering element is connected to its support frame by hydraulic ram means.

9. A drive shield according to claim 1, wherein the height of the knife shields is chosen to be considerably greater than the thickness of a concrete roof to be accommodated in the cavity, but less than the internal height of the finished structure.

10. In a drive shield for driving wide underground cavities and including a plurality of knife shields arranged side-by-side transversely of the direction of advance, an equal plurality of support frames individually associated with the knife shields, each knife shield having a plurality of elongate knives displaceably mounted on a respective support frame, and the elongate knives being advanceable relative to their support frame by means of hydraulic rams mounted on that support frame, the improvement comprising connecting means linking the support frames of each pair of adjacent knife shields together to permit one of the support frames to be advanced relative to the other.

* * * * *